US005311932A

United States Patent [19]

Sen et al.

[11] Patent Number: 5,311,932

[45] Date of Patent: May 17, 1994

[54] PROCESS AND APPARATUS FOR ENHANCING IN-TUBE HEAT TRANSFER BY CHAOTIC MIXING

[75] Inventors: Mihir Sen, South Bend; Hsueh-Chia Chang, Granger, both of Ind.

[73] Assignee: Gas Research Institute, Chicago, Ill.

[21] Appl. No.: 894,842

[22] Filed: Jun. 5, 1992

[51] Int. Cl.[5] ..... F28F 13/12

[52] U.S. Cl. ..... 165/109.1; 165/144; 165/163

[58] Field of Search ..... 165/109.1, 144, 145, 165/163

[56] References Cited

U.S. PATENT DOCUMENTS

| | | | |
|---|---|---|---|
| 2,115,769 | 5/1938 | Harris | 126/91 A |
| 4,444,357 | 4/1984 | Lynch et al. | 236/12.12 |
| 4,446,915 | 5/1984 | Welch et al. | 165/144 |
| 4,469,446 | 9/1984 | Goodboy | 366/342 |
| 4,798,241 | 1/1989 | Jarrett et al. | 165/109.1 |

FOREIGN PATENT DOCUMENTS

| | | | |
|---|---|---|---|
| 1430334 | 12/1966 | France | 165/144 |

OTHER PUBLICATIONS

Jones, Scott W., et al., *Chaotic Advection by Laminar Flow in a Twisted Pipe,* Journal of Fluid Mechanics, vol. 209, p. 335 (1989).

Peerhossaini, H., et al., *Chaotic Motion in the Dean Instability Flow—A Heat Exchanger Design,* Bulletin of the American Physical Society, Program of the 43rd Annual Meeting of the Division of Fluid Dynamics, vol. 35, No. 10, p. 2229 (1990).

*Order Breaking in Dean Flow,* Phys. Fluids A, vol. 3, No. 5, p. 1029 (May 1991), Le Guer, Yves, et al.

Tufillaro et al., "An Experimental Approach to Nonlinear Dynamics and Chaos," Addison-Wesley Publishing Co., p. 92 (1992).

Aref, H., "Stirring by Chaotic Advection," *Journal of Fluid Mechanics,* vol. 143, pp. 1-21 (1984).

*Primary Examiner*—John Rivell

*Attorney, Agent, or Firm*—Speckman, Pauley & Fejer

[57] ABSTRACT

A process and apparatus for enhancing in-tube heat transfer within a tubular member. A fluid is introduced into the tubular member and then directed in a downstream direction through a coil of the tubular member. The first coil defines a first coil axis. The fluid is further directed in the downstream direction through at least one downstream coil. Each downstream coil has a coil axis which is rotated at a coil switching angle, with respect to the coil axis of the immediately upstream coil. The fluid is maintained at a turbulent flow level within at least a portion of a coiled section of the tubular member. The fluid is then discharged from the tubular member.

10 Claims, 12 Drawing Sheets

PROCESS AND APPARATUS FOR ENHANCING IN-TUBE HEAT TRANSFER BY CHAOTIC MIXING

BACKGROUND OF THE INVENTION

1. Field of the Invention

This invention relates to a process and apparatus for achieving chaotic mixing of fluid flow through a coiled section of a tubular member for enhancing in-tube heat transfer, wherein the fluid flow is directed through a helical arrangement including coils having their corresponding coil axes positioned at some angle with respect to each other.

2. Description of Prior Art

Hydrodynamics of chaotic particle paths have been discussed within various publications, such as: Jones, Scott W., et al., *Chaotic Advection by Laminar Flow in a Twisted Pipe,* Journal of Fluid Mechanics, Vol. 209, p. 335 (1989), which states that chaotic advection of a passive scalar in steady laminar flow through a sequence of pipe bends leads to enhanced transverse and longitudinal stirrings, which is important to applications such as heat and mass transfer in piping systems; and Peerhossaini, H., et al., *Chaotic Motion in the Dean Instability Flow—A Heat Exchanger Design,* Bulletin of the American Physical Society, Program of the 43rd Annual Meeting of the Division of Fluid Dynamics, Vol. 35, No. 10, p. 2229 (1990). In *Order Breaking in Dean Flow,* Phys. Fluids A, Vol. 3, No. 5, p. 1029 (May 1991), Le Guer, Yves, et al. discuss combining large vortical structures in the flow with the dynamical behavior of open systems to enhance heat transfer and mixing, particularly in an apparatus having a succession of curved channels in which the curvature plane rotates 90° between each of two adjacent curved elements. Although such reference suggests that chaotic mixing is expected to enhance the advection of passive scalars and therefore improve the efficiency of heat transfer from the walls, such reference only discusses heat transfer with respect to laminar flow and does not even suggest the impact of chaotic mixing in a turbulent flow regime.

Other references have discussed increasing in-tube heat transfer by various mechanical methods. For example, U.S. Pat. No. 2,115,769 teaches a radiant heating tube which has spiral grooves or corrugations along which burning gases are whirled and eddied. The centrifugal forces cause the burning gases to swirl as they pass through the conduit.

U.S. Pat. No. 4,444,357 teaches a method and apparatus for mixing two input streams at different temperatures to form an intermediate combined stream at a regulated temperature. A heat exchange coil acts as a quick-response, continuous-flow heat exchanger, which alternately extracts and returns heat from differing-temperature pulses as the same merge and blend through their travel within the coil.

U.S. Pat. No. 4,469,446 discloses a fluid handling apparatus which has a plurality of hollow airfoil shaped vanes which are positioned within a first gaseous stream, and a second gaseous stream is conveyed through the hollow vane and is discharged into the first stream through a slot at the trailing edge of the vane.

Conventional passive techniques for enhancement of in-tube conventional heat transfer can be roughly classified into two categories: (1) increased effective heat transfer area; and (2) increased mixing methods. External and internal fins fall into the former category of conventional art, while the latter category of conventional art includes increased turbulence intensity and increased unsteady flow through inserts of various kinds, regular mixing in recirculation zones and resonant enhancement of flow instabilities. Some devices, of course, do both.

It is apparent that conventional technology and prior art references consider only chaotic fluid flow as it relates to flow within the laminar regime. It is very likely that persons skilled in the art of fluid mechanics and heat and mass transfer have not considered the effects of chaotic mixing of flow within a turbulent regime, since it would be expected that the increased energy requirements for pressure drops associated with turbulent flow would far outweigh any energy benefits realized through increased heat exchange efficiency.

SUMMARY OF THE INVENTION

It is one object of this invention to provide a process for obtaining increased heat transfer efficiency with fluid flowing through a tubular member, within the turbulent regime.

It is another object of this invention to provide an apparatus that is designed to accommodate chaotic fluid flow in the turbulent regime, based upon pre-determined or sensed operating parameters.

The above and other objects of this invention are accomplished with a process for enhancing in-tube heat transfer within a tubular member, wherein the fluid is introduced into the tubular member. The fluid is then directed in a downstream direction through a first coil of the tubular member and along a first coil axis of the first coil. The fluid is then further directed in such downstream direction, with respect to the first coil, through at least one other downstream coil, along a corresponding downstream coil axis of each respective downstream coil. Each downstream coil axis is rotated at an angle with respect to the coil axis of the immediately upstream and adjacent coil. The fluid is maintained at a turbulent flow level within at least a portion of a coiled section of the tubular member. Finally, the fluid is discharged from the tubular member.

According to one preferred embodiment of this invention, the tubular member of the heat exchange apparatus which accommodates the process for enhanced in-tube heat transfer has a fluid inlet and a fluid outlet. With respect to the downstream direction, the tubular member forms a coiled section with a first coil formed along and defining a first coil axis. Downstream of the first coil, at least one downstream coil is formed along another coil axis defined by the corresponding downstream coil. Each downstream coil axis is rotated at an angle with respect to a corresponding coil axis of an immediately upstream and preferably adjacent coil. At low velocities the flow is generated from an overhead tank, for example, and at high velocities from a faucet or other pressurized source so that the turbulent fluid flow can be maintained through at least a portion of the coiled section.

According to this invention, fluid particle paths are calculated using the classical perturbation solution of Dean for the secondary flow. Chaotic mixing is confirmed by determining a positive Lyapunov exponent. The temperature field can be calculated numerically to show that chaotic mixing is responsible for considerable flattening of the temperature profile and for an increase in convective heat transfer. Experiments were conducted, according to this invention, with water using two coiled tube geometries over a Reynolds number Re range of about 3,000–10,000. Both coils were identical in every technical respect except that one was a conventional coil with a constant axis, while the other was a coil with an alternating axis, according to this invention. Of the two tested coils, the alternating axis coil according to this invention showed a 6–8% higher in-tube heat transfer coefficient due to chaotic mixing, with a corresponding pressure drop increase of 1.5–2.5%.

It is much more difficult to achieve heat transfer enhancement in heat exchange apparatuses operating without turbulent flow or instability. Laminar flow, in general, results in relatively poorer rates of heat transfer, compared to turbulent or unsteady flow. For example, considering heat transfer from the fluid to the walls at the in-tube side of a heat exchanger tube, if the steady streamlines are parallel to the walls of the tube, then heat transfer in a transverse direction is due only to conduction, the relatively slow molecular effect. Such process can be enhanced according to this invention, by fluid exchange or mixing between the interior and the region near the walls, increasing thus the advective component of the heat transfer. In a turbulent or unstable flow, such mixing is normally present due to transverse fluctuations in the fluid velocity.

It is important to note that when mixing with either laminar flow or turbulent flow, such mixing also leads to momentum transfer in a direction transverse to the flow. Consequently, the associated wall shear stresses and pressure drops are higher, resulting ultimately in larger pumping requirements and costs. The pressure drop increase can be quite significant for augmentation procedures such as inserts and internal grooves since they introduce an additional frictional surface or roughness. Even though teachings of prior art references tend to ignore chaotic mixing in a turbulent regime, this invention particularly relates to flow within this regime since as proven by experimentation, chaotic flow within the turbulent regime produces quite favorable unexpected results. This invention considers devices which do not involve inserts or do not affect the frictional characteristics of the inner wall, but rather provide heat transfer enhancement by way of fluid mixing, chaotic fluid mixing.

There is a distinction between chaotic mixing and regular mixing. Regular mixing occurs due to secondary motion in a helically coiled tube with laminar, steady flow in which the heat transfer is substantially improved when compared to laminar, steady flow through a straight tube. However, the streamlines of the two secondary vortices that are produced in a transverse plane are closed curves, and the fluid particles moving along such streamlines do not mix with each other. The fluid near the core of the vortices does not mix at all in such flow. It is possible to perturb such secondary flow by periodic changes in coiling geometry which generates chaotic particle pathlines and greater mixing. Such perturbation can be produced in a relatively simple manner by changing the axis of the coil with predetermined spatial periodicity.

BRIEF DESCRIPTION OF THE DRAWINGS

The above and other objects as well as the technical aspects of this invention will become more apparent when the specification is read in view of the drawings, wherein.

DESCRIPTION OF PREFERRED EMBODIMENTS

Figure 1:
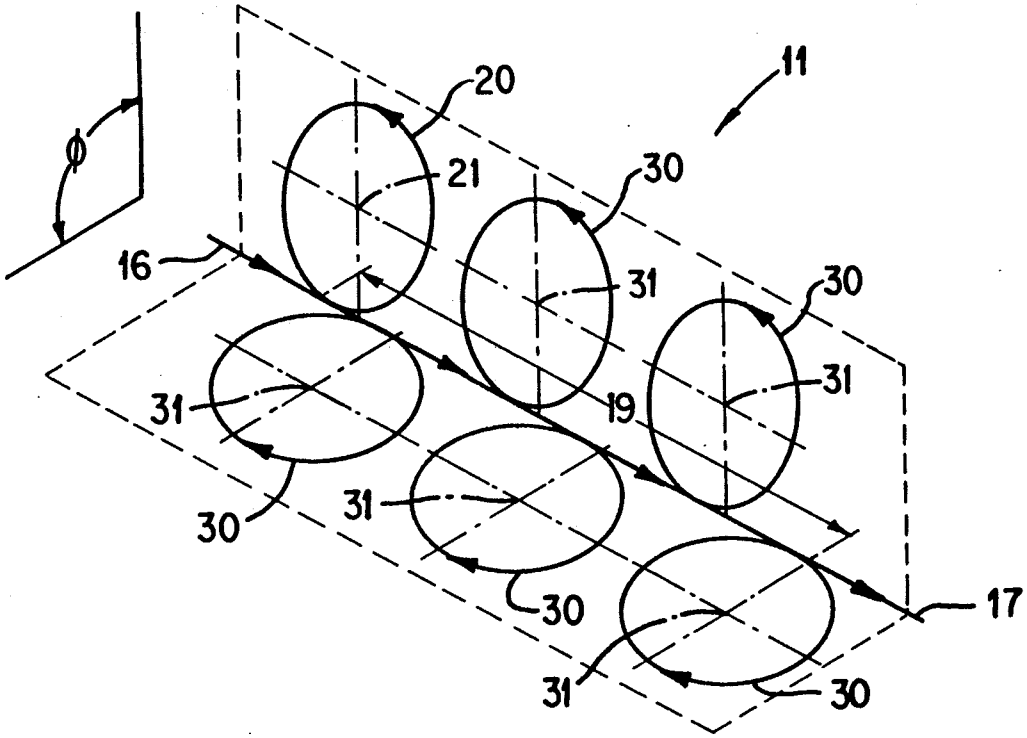
FIG. 1 is a schematic three-dimensional diagram showing one preferred flow path of chaotic mixing, according to one preferred embodiment of this invention.
Figure 7B:
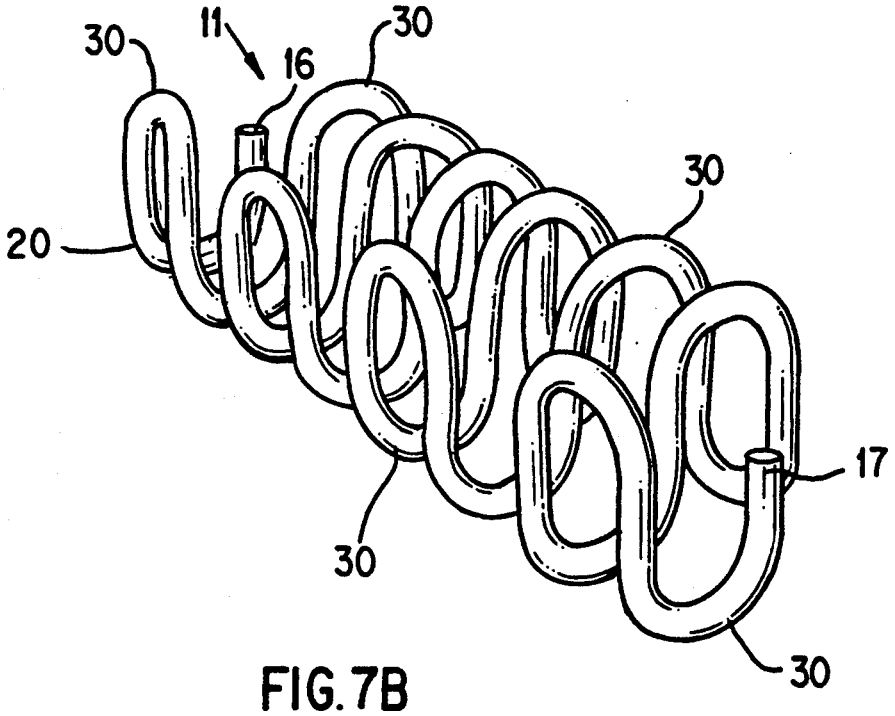
FIG. 7B is a perspective view of an alternating axis coil, according to one preferred embodiment of this invention.
Figure 7A:
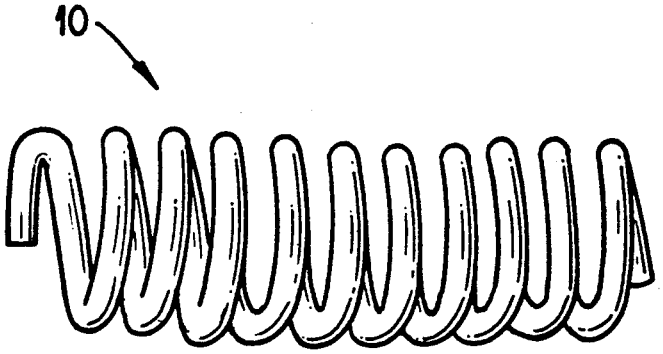
FIG. 7A PRIOR ART
FIG. 7A is a perspective view of a conventional constant axis coil.

Experimental results were obtained according to the process and apparatus of this invention, with an alternating axis coil which produced a flow pattern as shown in the three-dimensional schematic diagram of FIG. 1. FIG. 7B shows a perspective view of alternating axis coil 11, according to one preferred embodiment of this invention. FIG. 7A shows a perspective view of a conventional constant axis coil 10 that was used for comparison purposes throughout experiments conducted according to this invention.

Figure 6:
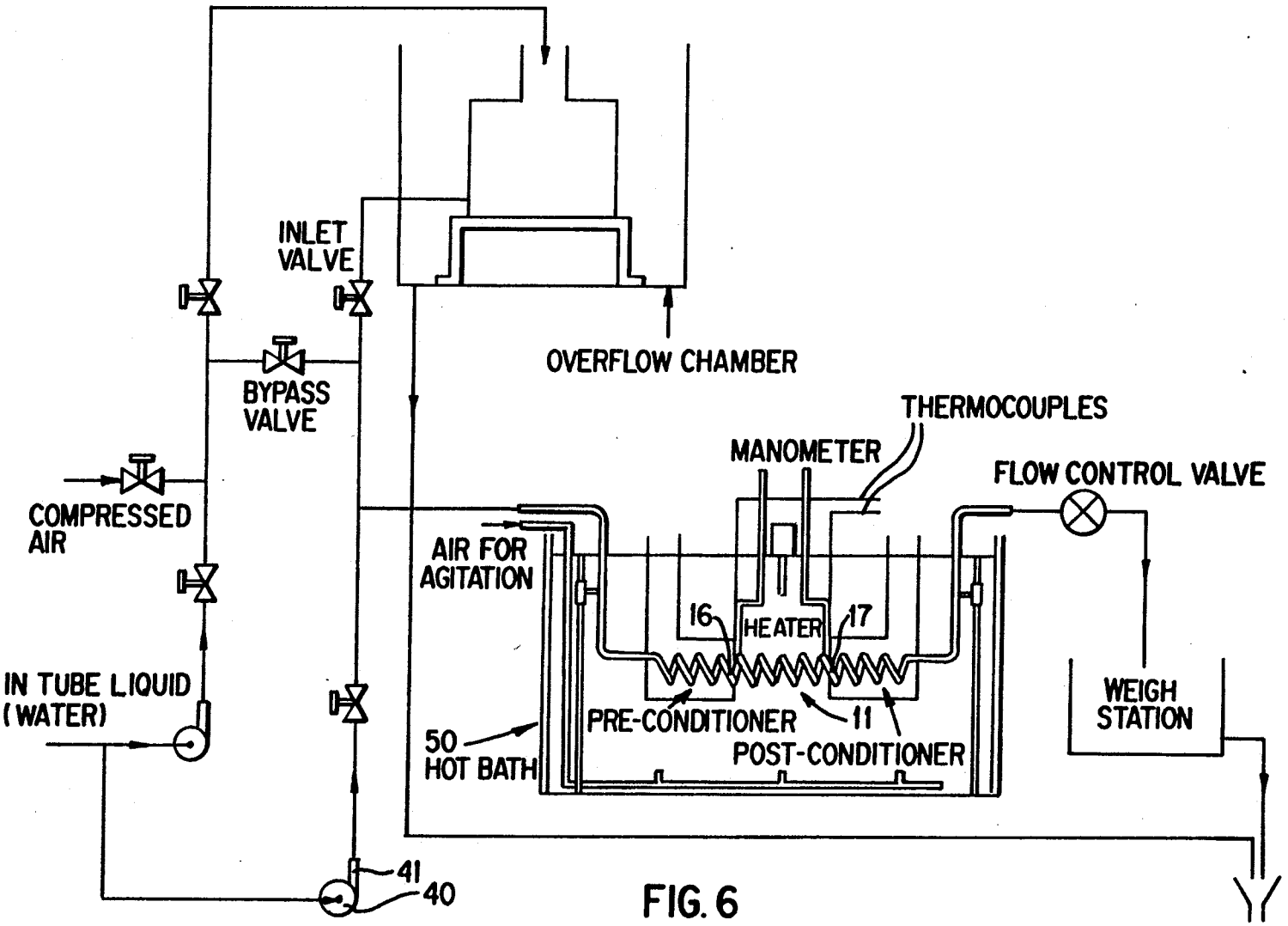
FIG. 6 is a schematic diagram of an experimental set-up, according to one preferred embodiment of this invention.

In a preferred process for enhancing in-tube heat transfer within tubular member 15, according to this invention, fluid is introduced into tubular member 15, for example at fluid inlet 16, as shown in FIGS. 1, 6 and 7B. The fluid is then directed in a downstream direction, as indicated by the direction of the arrows as shown in FIG. 1, through first coil 20. First coil 20 defines first coil axis 21 by the general plane, as shown in FIG. 1, in which the fluid flows through first coil 20. As best shown in FIGS. 1 in view of FIG. 7B, downstream coil axis 31 of each downstream coil 30 is rotated at a coil switching angle $\phi$, with respect to a corresponding coil axis 21 or 31 of an immediately upstream coil. By the term "upstream coil" as used in the specification and throughout the claims, it is intended to relate to a coil of tubular member 15 which is upstream and not necessarily but preferably adjacent to the specific coil. As shown in FIGS. 1 and 7B, it is apparent that each downstream coil axis 31 is rotated approximately 90° with respect to the coil axis of the immediately upstream coil. However, it is also apparent that other suitable coil switching angles $\phi$ can be used to accomplish the same result of this invention, enhanced in-tube heat transfer.

The fluid is directed in the downstream direction from first coil 20 to at least one downstream coil 30. The phrase "at least one downstream coil" is intended to relate to one or more coils, preferably a multiplicity, positioned at the coil switching angle $\phi$, with respect to each upstream coil 20 or 30. After passing through coiled section 19 of tubular member 15, the fluid is discharged from tubular member 15, such as through fluid outlet 17.

It is an important aspect of this invention to note that the fluid is maintained at a turbulent flow level within at least a portion of coiled section 19. Means for maintaining turbulent fluid flow through coiled section 19 may include any suitable pump or other fluid transfer device or system set-up for providing sufficient pressure and flow conditions through tubular member 15. For example, as schematically shown in FIG. 6, alternate pump 40 has pump discharge 41 which is in fluidic communication with fluid inlet 16 of tubular member 15. It is apparent that pump 40 is a positive pressure pump as positioned in FIG. 6 but that pump 40 can also be a vacuum pump positioned elsewhere in the system shown in FIG. 6.

Again, it is a very important aspect of this invention to note that the fluid is preferably maintained at the turbulent flow level or controlled within the turbulent flow regime. The means for maintaining turbulent fluid flow, in one preferred embodiment of this invention, is capable of maintaining the fluid flow at a Reynolds number Re of greater than approximately 7,000, particularly when water is the working fluid. A person skilled in the art of fluid mechanics and heat and mass transfer would expect that increasing the fluid flow into a turbulent regime through tubular member 15, as shown in FIG. 7B for example, would result in a significant increase in pressure drop, particularly with the increased number of abrupt flow direction changes through the many curved sections of coiled section 19, which would require more input energy for the pumping means than would be saved due to the enhancement of the in-tube heat transfer resulting from such turbulent flow. However, results of experiments conducted according to this invention prove that increasing the fluid flow into the turbulent regime unexpectedly increases the in-tube heat transfer efficiency to an extent that the associated energy savings would outweigh the additional energy requirements associated with maintaining turbulent flow through tubular member 15 having alternating axis coil 11.

As shown in FIG. 7B, the geometry of alternating axis coil 11 is a loosely coiled tube of generally circular cross-section. A polar coordinate system was employed with radial, angular and axial coordinates. The tube radius is a, and the coil radius is R. The length or circumference of a single coil, such as first coil 20, and downstream coil 30, as shown in FIG. 7B, is $l=2\pi R$. Tubular member 15 switches or alternates the axis after a distance $z^*_s$. The radius ratio $\delta=a/R$.

Figure 2A:
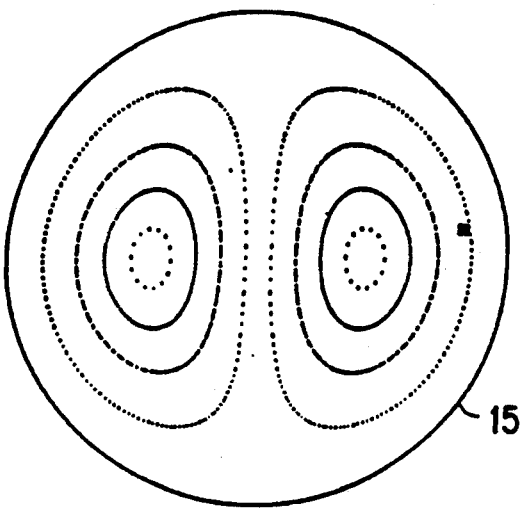
FIG. 2A is a cross-sectional view taken along streamlines of the flow path within a tubular member, according to this invention, wherein approximately 400 initial particles are shown.
Figure 2B:
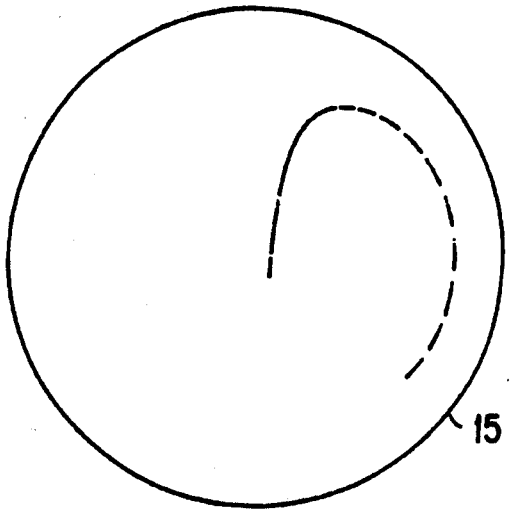
FIG. 2B is a cross-sectional view of a tubular member of a constant axis coil, showing final positions of the particles wherein the axial distance is equal to $19z_s$.
Figure 2C:
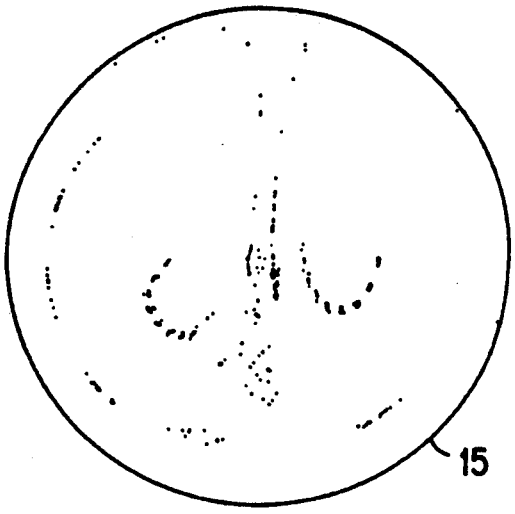
FIG. 2C is a cross-sectional view of the tubular member of this invention, showing particle positions within an alternating axis coil, wherein the axial distance is equal to $3z_s$, and the coil switching angle $\phi$ is equal to 90°.
Figure 2D:
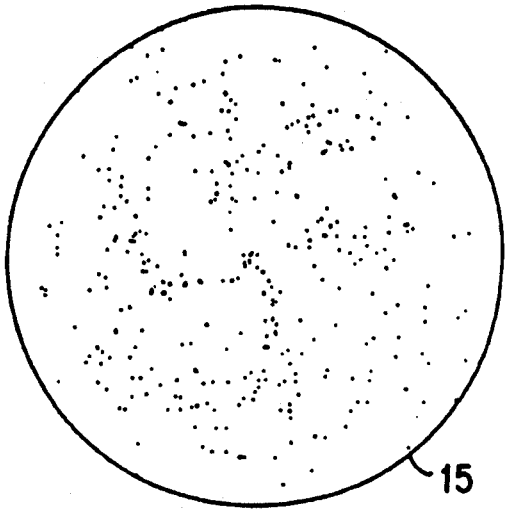
FIG. 2D is a cross-sectional view of the tubular member according to this invention, showing particle positions within an alternating axis coil, wherein the axial distance is equal to $6z_s$, and the coil switching angle $\phi$ is equal to 90°.

Results obtained from experiments conducted with constant axis coil 10 and alternating axis coil 11 were compared by computing the spread of the set of particles simulating the spread of a blob of dye. A switching length $z_s$ for alternating axis coil 11 was taken as unity. A set of 400 fluid particles were initially located within the small darkened square shown in FIG. 2A. For constant axis coil 10 with regular mixing, such particles formed at the positions shown in FIG. 2B, after an axial distance of $19z_s$. With alternating axis coil 11, the same set of initial fluid particles mixed much more thoroughly over the cross section of the tube. The locations of the particles at an axial distance of $3z_s$ and $6z_s$ are shown in FIGS. 2C and 2D. In FIG. 2D, after only five changes in the direction of coil axis 21 or 31, good mixing is shown to have been achieved.

Lyapunov exponents represent the long-time mean exponential growth rates of neighboring trajectories in phase space and are used to identify the presence of chaos in particle pathlines. A positive value of largest Lyapunov exponent indicates that the system is chaotic. The secondary motion of the fluid particles obeys the Hamiltonian system and the sum of the Lyapunov exponents is zero. FIG. 2D shows that there are no "islands" in the flow domain where chaotic mixing is absent; their trajectories fill up the entire space. Particle trajectories can be numerically calculated from the velocity field and the flow can be reduced to a mapping over each period of coil 20 or 30. For alternating axis coil 11 according to the experiments of this invention, the Lyapunov exponent was positive which confirmed that the flow trajectories were indeed chaotic.

Figure 3A:
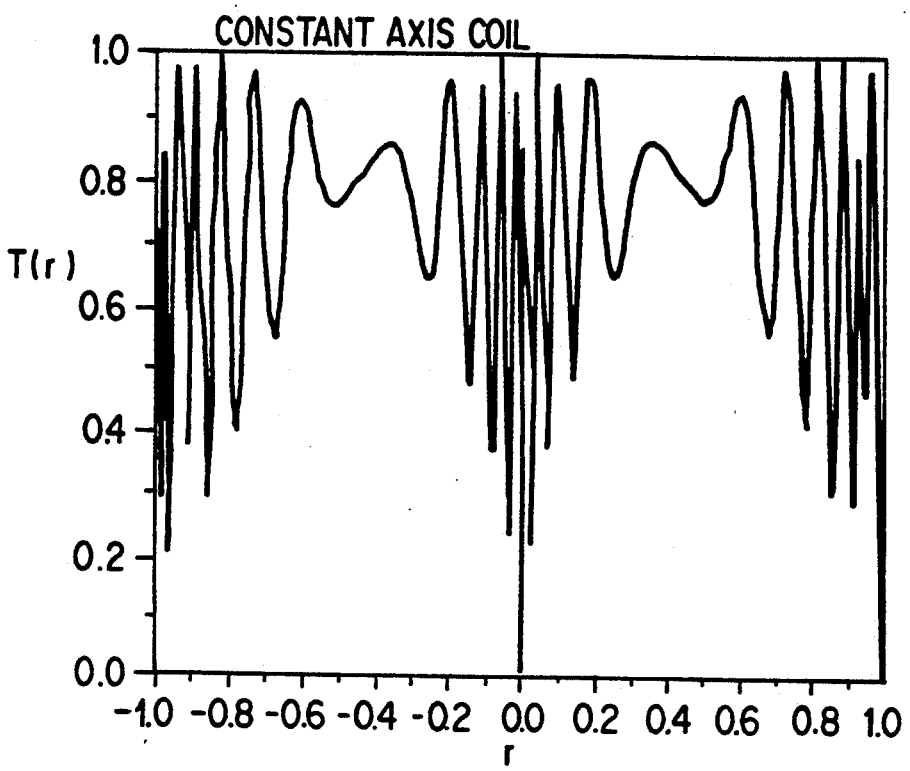
FIG. 3A is a graph showing computed results of a temperature profile of a constant axis coil, with an infinite Prandtl number Pr, wherein the coil switching angle $\phi$ is equal to 90°.
Figure 3B:
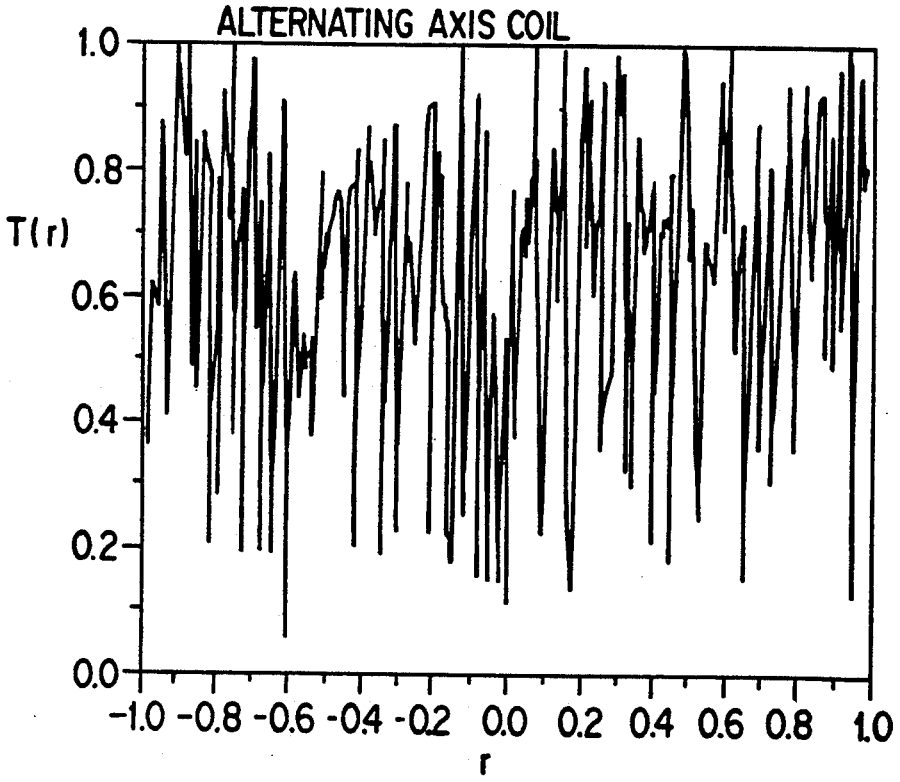
FIG. 3B is a graph showing computed results of a temperature profile of an alternating axis coil, with an infinite Prandtl number Pr, wherein the coil switching angle $\phi$ is equal to 90°.

The temperature profile along the diameter at $\theta=0$ at the outlet section of coiled section 19 is plotted in the graphs of FIGS. 3A and 3B, for an assumed parabolic inlet temperature profile, $T(r)=1-r^2$, for both coils 10 and 11. For fluids with finite Prandtl number Pr, there may be some thermal diffusion, the effect of which will be to smooth out the temperature profiles. However, to account for the thermal diffusion, it is necessary to solve the energy equation for the temperature field. As the Reynolds number Re increases, the secondary flow increases in relative strength. As the flow approaches its fully developed nature with a constant wall temperature, the advection in the axial direction disappears, and the secondary flow is then responsible for the advection of heat between the fluid and the walls. The advective term increases with $\delta RePe$, indicating that the best advantage is obtained with tight coiling, high Reynolds number Re, and large Prandtl number Pr fluids. Considering extreme examples, as $\delta \rightarrow 0$, tubular member 15 becomes straight and secondary flow disappears; as the Reynolds number $Re \rightarrow 0$, the secondary flow also vanishes; as the Peclet number $Pe \rightarrow 0$, the fluid becomes one of high thermal diffusivity in which conduction carries all of the heat, and advection is negligible; as the Peclet number $Pe \rightarrow oo$, the material derivative of the temperature $DT/Dt=0$, so that the temperature does not change on following a fluid particle. In general, such remarks are valid for regular mixing as well as chaotic mixing.

The Nusselt number Nu can be calculated. The Nusselt number Nu is considered to be fully developed when it varies less than 0.2% in the z-direction.

Comparison tests between constant axis coil 10 and alternating axis coil 11 focused upon three system parameters: the Reynolds number Re, the Prandtl number Pr, and the switching angle $\phi$. The radius ratio $\delta$ was kept constant at 0.1 for all experimental test runs. Use of Dean's solution for the flow field renders the solution valid for relatively small Dean numbers De only, for example up to about $De=18$. Thus, the parameter $De^2Pr$ can be increased only by increasing the Prandtl number Pr of the working fluid. The Reynolds numbers Re and the Prandtl numbers Pr are preferably kept as separate parameters.

Since the axial flow to lowest order is unaffected in Dean's perturbation solution, the pressure drop computed under this approximation is the same for both constant axis coil 10 and alternating axis coil 11. It is in fact the same as that for a straight tube. Thus, it was determined that the increase in power required to pump fluid through tubular member 15 with coil section 19 is of lower magnitude than the gain in the energy related to the heat transfer efficiency.

Figure 4A:
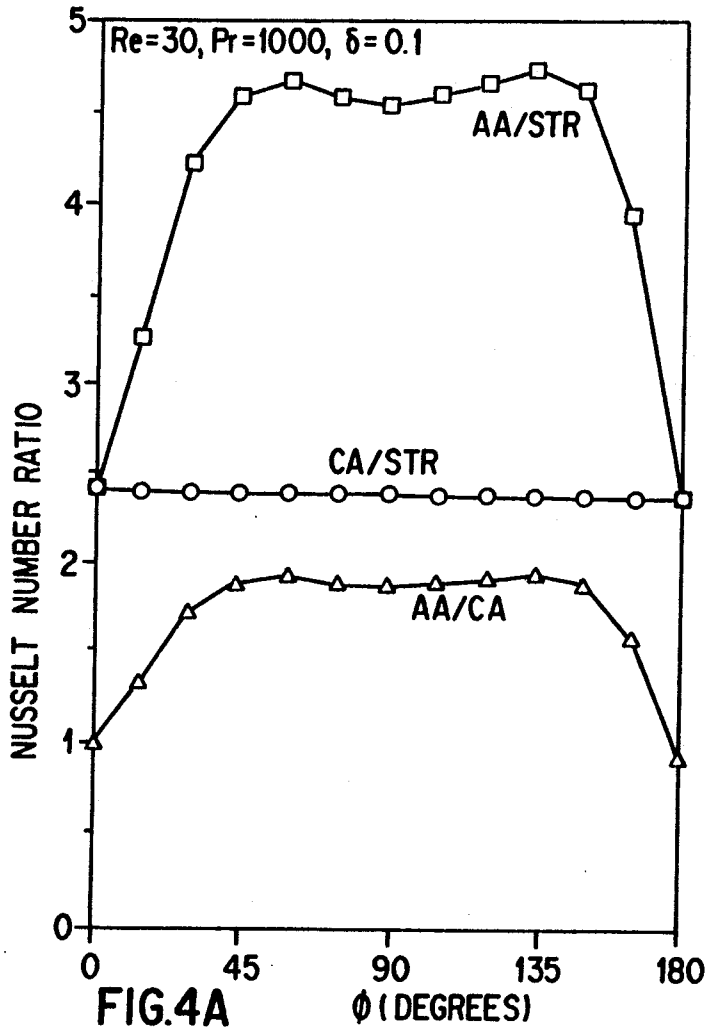
FIG. 4A is a graph showing computed results of the Nussult number Nu ratio as a function of the coil switching angle $\phi$.
Figure 4B:
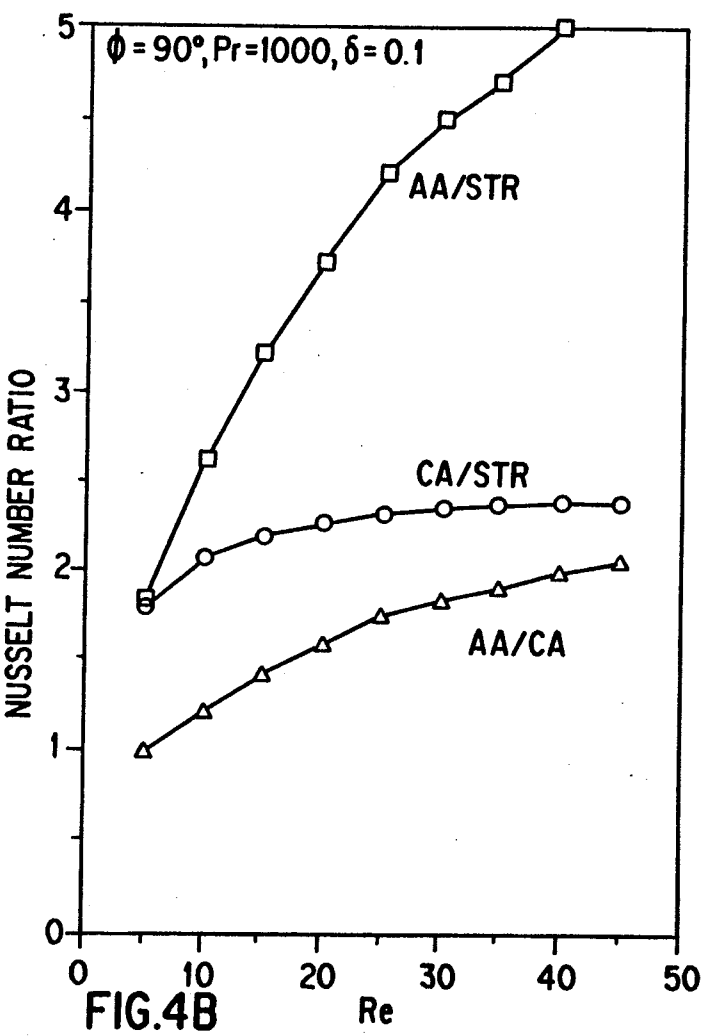
FIG. 4B is a graph showing computed results of the Nussult number Nu ratio as a function of the Reynolds number Re.
Figure 4C:
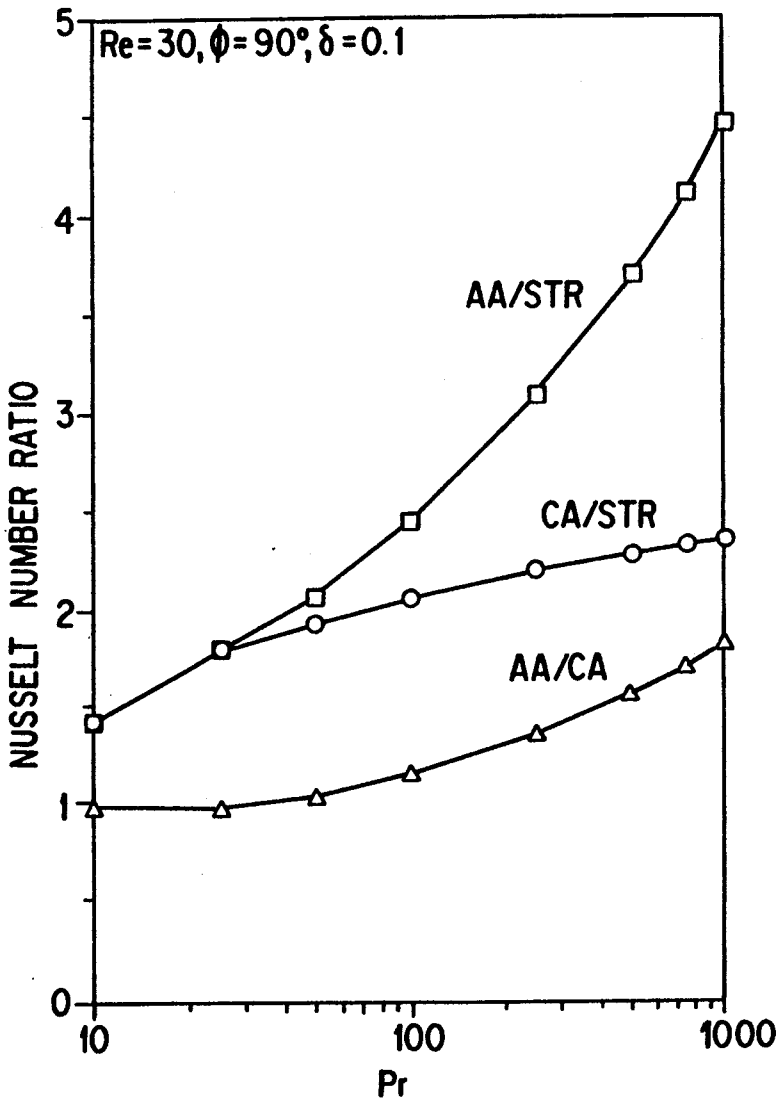
FIG. 4C is a graph showing computed results of the Nussult number Nu ratio as a function of the Prandtl number Pr.

FIGS. 4A–4C show graphical results of numerical computations expressed in the form of ratios of fully developed Nusselt numbers Nu. Three different cases were compared: a straight tubular member 15 (STR), constant axis coil 10(CA), and alternating axis coil 11(AA). The corresponding ratios are indicated by the symbols; AA/STR, CA/STR, and AA/CA. It is apparent that a significant increase in heat transfer occurs as coil switching angle $\phi$ is increased from 0° to 45°. For a subsequent increase in coil switching angle $\phi$, there is little change in the overall Nusselt number Nu. The switching action of the coil axes within alternating axis coil 11 accomplishes a mixing of fluid particle trajectories so that the resulting temperature profile is flatter than that in constant axis coil 10. Also, the variation in the Nusselt number Nu enhancement is not exactly symmetric about 90°.

An increase in the Reynolds number Re increases the strength of the secondary flow vortices and in turn leads to better mixing within coiled section 19. Consequently, transverse mixing across the central barrier is improved with switching and the heat transfer efficiency is higher for larger Reynolds numbers Re. The Prandtl number Pr also has an effect similar to the Reynolds number Re. Enhanced mixing occurring in alternating axis 11 is a result of convective motion which is relatively strong compared to thermal diffusion for relatively high Prandtl number Pr fluids. For low Prandtl number Pr fluids, diffusion tends to smear out the temperature profile and tends to reduce the effective contribution of the convective heat transfer At relatively low Prandtl numbers Pr, there is little difference in the heat transfer between constant axis coil 10 and alternating axis coil 11.

Figure 5A:
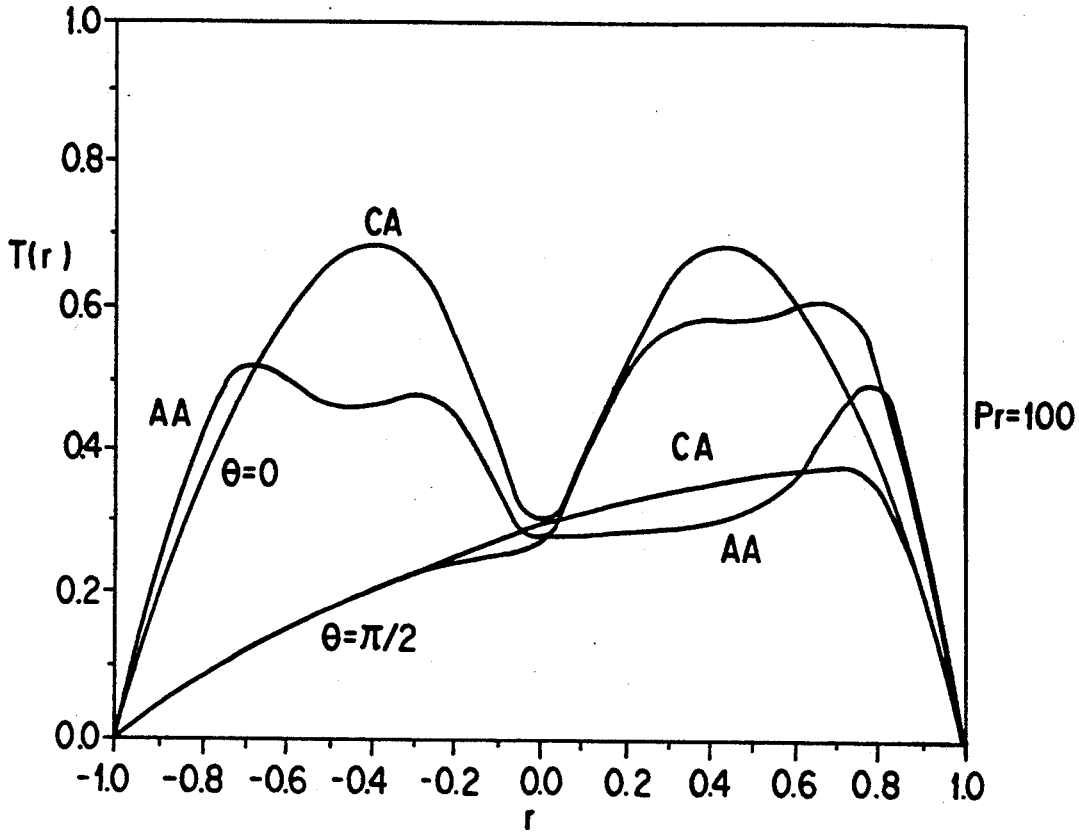
FIG. 5A is a graph showing a temperature profile at the angular coordinate $\theta=0$ and $\theta=90°$, for Pr=100, wherein Re=30, the radius ratio $\delta=0.1$, and the coil switching angle $\phi=90°$.
Figure 5B:
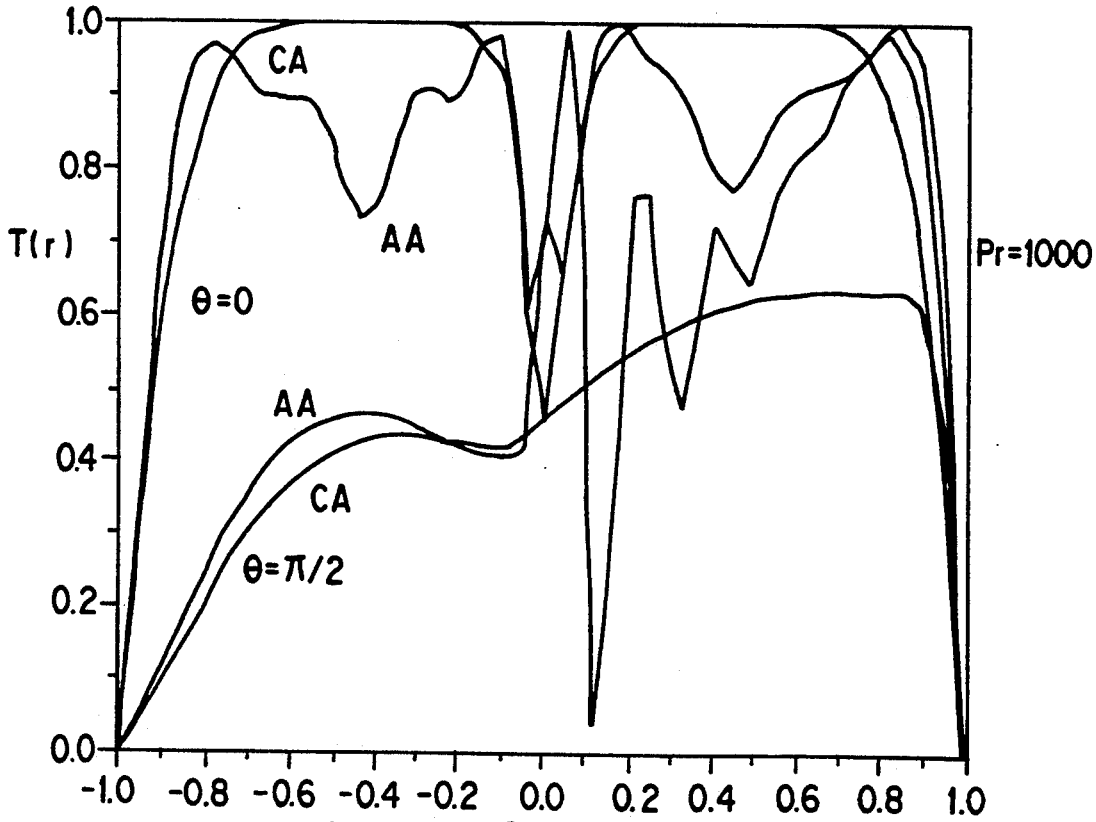
FIG. 5B is a graph showing a temperature profile at the angular coordinate $\theta=0$ and $\theta=90°$, for Pr=1000, wherein Re=30, the radius ratio $\delta=0.1$, and the coil switching angle $\phi=90°$.

FIGS. 5A and 5B show temperature profiles at $\theta=0$ and at $\theta=90°$ diameters for two different Prandtl numbers Pr. The temperature profiles display a typical double hump in the transverse plane, perpendicular to the plane of curvature, corresponding to the pair of vortices in the flow. At relatively high Prandtl numbers Pr, the temperature near the wall and center of tubular number 15 dropped appreciably due to convective action while the region within the cores of the vortices are nearly at the initial temperature. The symmetry in the temperature profile is lost in alternating axis coil 11, due to periodic mixing in the zones adjacent to the plane of axis switching. The flow retains global character of a double hump since in the regions between the mixing zones, it is still governed by Dean's equations. For alternating axis coil 11, the mixing action leads to a chaotic exchange of the cold and hot fluid particles causing the hump to lower and smear out. The result is that the temperature profile becomes flatter with a steeper wall temperature gradient accompanied by a smaller bulk temperature. This increases the Nusselt number Nu for alternating axis coil 11.

Experiments and Experimental Results

Comparative experiments on constant axis coil 10 alternating axis coil 11 were carried out in order to obtain a measure of their relative performance in terms of heat transfer and pressure drop. Since coils 10 and 11 were tested over a range of Reynolds numbers Re, the most appropriate comparison is based on the inner heat transfer coefficient as well as the pressure drop in this range.

The mechanism responsible for the chaotic pathlines is the periodic switching of coil axis 21 and 31 in the downstream direction. Thus, the effect of chaotic mixing in alternating axis coil 10 is manifested in the portion of coiled section 19 immediately downstream of the locations of axis switching. For the remainder of tubular member 15, the particle paths and mixing are similar to that in constant axis coil 10. Consequently, it would appear that in order to observe a noticeable effect of chaotic mixing, coiled section 19 should have a large number of axis switches per unit length. But, on the other hand, there is a limitation on the frequency at which the coil axis switching can occur. After a switch of coil axis 21 or 31, the flow field needs a certain transition length before it attains a developed form of Dean vortices and adjusts itself to the new curvature. It is likely that chaotic mixing is most effective when the flow near the end of its transition length is subjected to a switch in the relative angle of coil axis 21 or 31. If coil axis 21 or 31 is switched much more frequently than this, the effect of chaotic mixing diminishes, an effect that can be seen in numerical simulations. This points to an optimum switching length for maximum heat transfer enhancement, according to this invention. However, no optimization was attempted because of the inapplicability of the present numerical analysis to experimental conditions.

In order to reduce the flow instabilities and fluctuations to a minimum, an open-loop gravity driven flow system, similar to the system shown in FIG. 6, was used for experimentation purposes. Water was used both inside and outside coils 10 and 11 Cold water was pumped into a 10 liter overhead tank at a height of 4 m above the floor level. The overhead tank was inside an overflow chamber so as to provide constant head. Water flowed from the overhead tank by gravity through 15.9 mm diameter copper tubing to the test section in bath 50, and then to a drain tank which also served as a weigh station. The flow control valves were positioned at a distance of approximately 30 diameters downstream of the test section to minimize flow disturbances upstream.

The test section comprised three parts: a coil 10 or 11, a pre-conditioner before and a post-conditioner coil after coil 10 or 11 being tested. The purpose of the pre-conditioner, 20 diameters long, was to produce an entrance section in which a secondary motion was established before the fluid reached the test section. Another objective was to provide enough mixing so that the measured temperature could be interpreted as a bulk temperature. The post-conditioner of 15 diameters length reduced the effect of the exit conditions on the test coils 10 and 11, as well as providing once again enough mixing for the temperature measurement. To reduce heat transfer from the conditioner coils to hot bath 50, air-filled Plexiglas TM enclosures were provided around them and were fabricated from 6.4 mm thick Plexiglas TM sheets cut to required size and cemented together with acrylic weld-on liquid.

Constant axis coil 10 and alternating axis coil 11 were identical in every way except their coiling geometry. This was achieved by making coils 10 and 11 out of a number of identical 180° return bends of copper with in-tube and mean coil radii of 10.9 mm and 50.8 mm respectively which were available. The bends were soldered end to end with 25 mm long intervening pieces of copper tubing machined to the same inner diameter; for each coil, 21 bends were used to give a total length of 2.677 m, i.e. 245 diameters in length. It turns out that this corresponds to a curvature ratio $\delta=0.2$ and $z_s=1/2$ for each bend of the coil. There are several designs possible for coils with alternating axes. As used throughout experimentation, alternating axis coil 11 had the benefit of being externally similar to constant axis coil 10 in order to minimize the difference in the outer heat transfer coefficient FIGS. 7A and 7B show coils 10 and 11 that were used in the experiments conducted according to this invention.

The entire test section was placed in a 450 mm×600 mm×500 mm HDPE bath 50, as shown in FIG. 6, insulated on all sides with 19 mm thick Thermax TM sheathing made of glass fiber reinforced poly-isocyanurate foam board with reflective aluminum foil facers. Bath 50 was filled with distilled water heated by a 220 V, 1.4 kW immersion circulator equipped with thermostatic temperature control. Two additional immersion heaters with a total capacity of 4.5 kW and equipped with thermostatic control were used for auxiliary heating to supplement the heating provided by the immersion heater. A circulation pump integral with the immersion thermostat provided continuous circulation of water in bath 50. As this was found to be inadequate in maintaining a spatially uniform bath temperature, dry air was bubbled through bath 50 at a fixed rate to provide for better mixing. Another purpose of the continuous flow and agitation of water in bath 50 was to achieve a relatively high outer heat transfer coefficient in coils 10 and 11. Coils 10 and 11 were clamped to end plates placed inside bath 50 to provide rigidity and to minimize the effect of pump vibrations.

The in-tube inlet and exit water temperatures were measured with a pair of Teflon TM coated, gage 30, copper-constantan thermocouples. The thermocouple junction was relatively small so as to achieve accuracy in local measurements. The thermocouples were soldered to the bottom of 10 mm long pieces of 2.36 mm diameter brass tubing penetrating the tube wall of the conditioner coils close to the ends of the test coil section. The bath temperatures were monitored by three thermocouples placed at different spatial locations and depths, the difference in temperature between them being less than 0.1° C. The flow rate was measured by timing a fixed volume of water with a stop-clock having a resolution of 0.01 s. Pressure at the inlet and exit of tubular member 15 was measured with a specially fabricated manometer connected to these stations.

Since the presence of air bubbles could significantly affect the heat transfer results, it was essential to remove bubbles entrapped in the test and conditioning coils. This was done by using the bypass line to let water under high pressure through coils 10 and 11. The bypass line was then closed and water allowed to flow directly from the overhead tank for the test. Bath 50 was then heated to about 50° C. After steady state had been attained after several hours, the temperature, pressure and flow rates were recorded. The flow rate was then changed in steps and all readings recorded after steady state was attained.

The experiments were conducted with flow of cold water in the in-tube side and warm water in the over-tube side of the experimental heat exchanger set up. The total thermal resistance between the two fluids was that due to the inner and outer heat transfer coefficients, as well as the heat conduction through the tube wall, which is very small. The inner coefficient was determined by measuring the overall and the outer coefficients.

Figure 8:
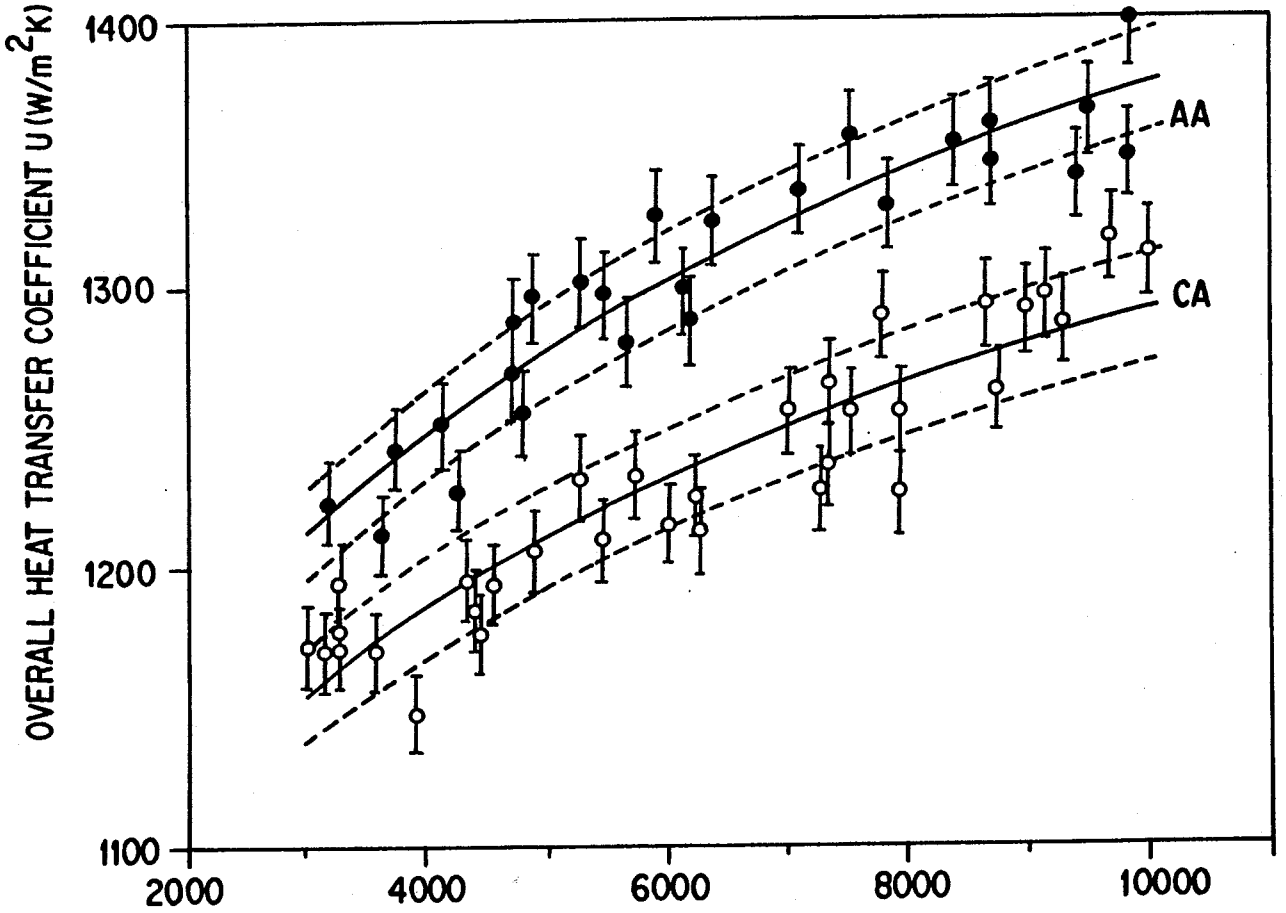
FIG. 8 is a graphical representation of experimental results showing the overall heat transfer coefficient U as a function of the Reynolds number Re.

The inlet, outlet and bath temperatures were measured for each test run, in addition to the mass flow rate of water in coil 10 or 11. The overall heat transfer coefficient U was determined using fluid properties at the mean inlet-outlet temperature. The Reynolds number Re was determined from the mass flow rate, using the mean velocity and the tube inner diameter as characteristic scales. The measurements were carried out over a range of flow Reynolds numbers Re, the results of which are shown in FIG. 8. The associated errors which are discussed below are also shown in FIG. 8. The values of U for the alternating axis coil 11 configuration are seen to be consistently higher than that of the conventional constant axis coil 10 configuration. The difference is larger than both the error as well as the scatter in the data. The outer heat transfer coefficient was determined by measuring the transient response of coils 10 and 11 to a step change in the outside surface temperature. For this purpose, coil 10 or 11 was suddenly dipped in a hot water bath at a constant temperature of 50° C. and the variation in wall temperature with time was obtained from a thermocouple soldered to the outer surface. The attachment of the thermocouple to the wall is critical since any thermal resistances introduced there would indicate a falsely lower value for the outer coefficient. After several attempts it was found most accurate to simply solder the thermocouple wire to the outer surface of the coils.

The time constant of the thermocouple, determined by plunging it into boiling water, was found to be around 0.025 s. Thus, it was adequate to measure the transient response of coils 10 and 11 which was much slower than 0.025 s. Since the conductive time scale over the coil wall thickness is two orders of magnitude smaller than this value, coil 10 or 11 was assumed to be a lumped mass system. The inside of coil 10 or 11 during these tests contained only air of negligible thermal capacity.

A lumped mass analysis was used to determine the outer heat transfer coefficient. The results show that $h_{O(CA)}=4635.4$ W/m$^2$K and $h_{O(AA)}=4809.0$ W/m$^2$K. There is a slight difference between the $h_O$ of the two coils 10 and 11 because of the different geometries and flow patterns on the outside, alternating axis coil 11 being slightly more open to external flow.

Figure 9:
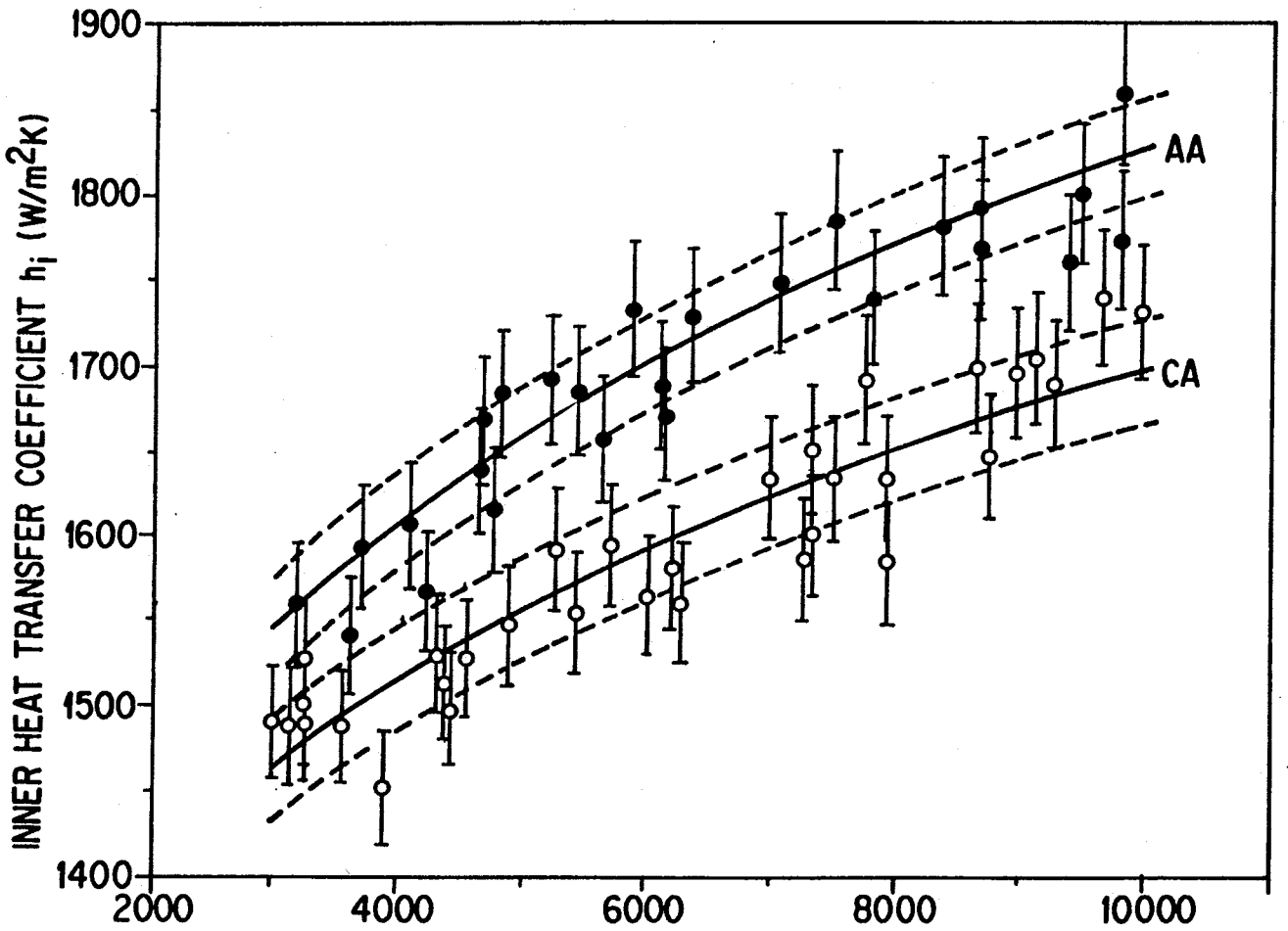
FIG. 9 is a graphical representation of experimental results showing the inner heat transfer coefficient h as a function of the Reynolds number Re.
Figure 10:
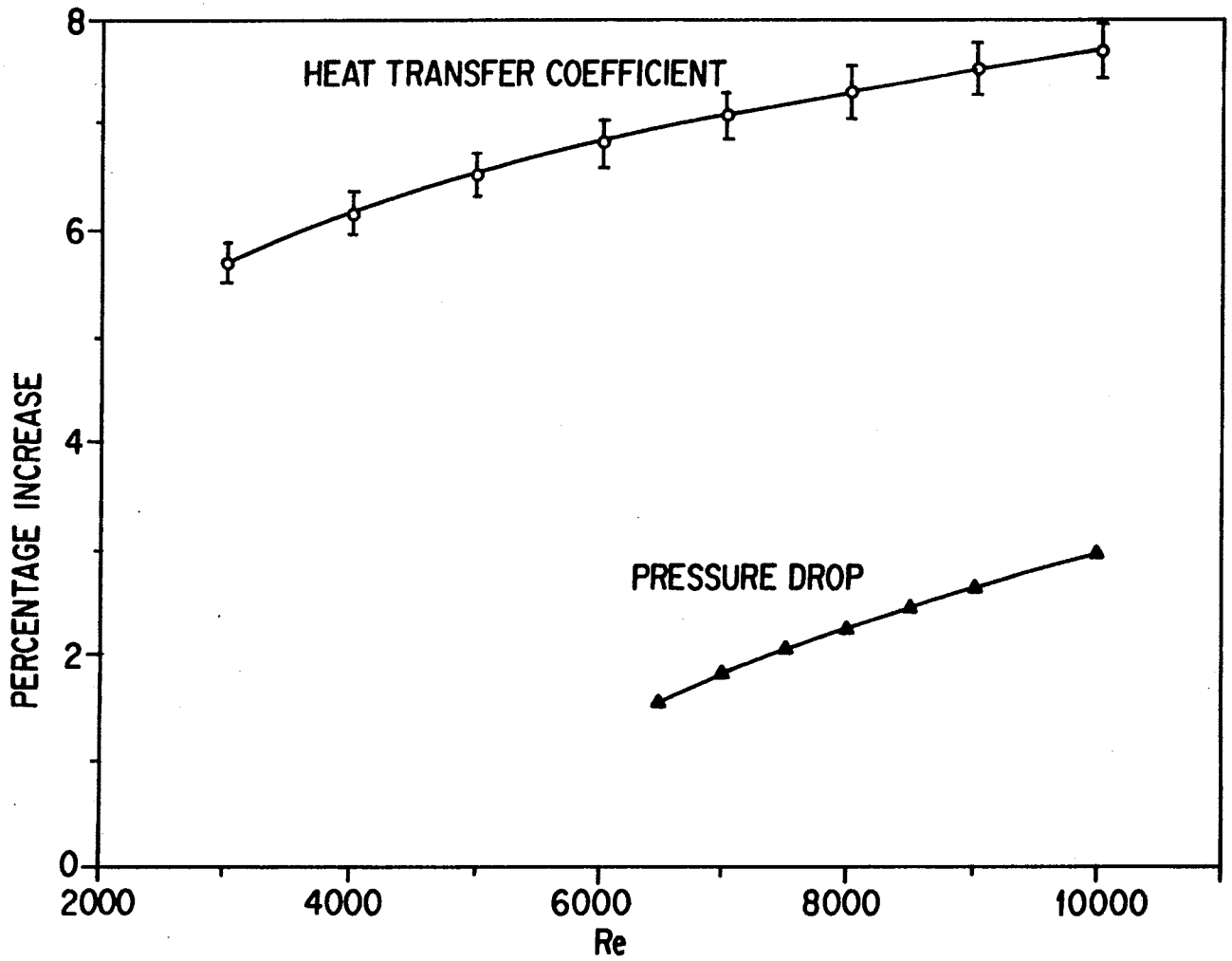
FIG. 10 is a graphical representation of experimental results showing the relative percentage increase of the heat transfer coefficient and the pressure drop, each as a function of the Reynolds number Re.

The inner heat transfer coefficient can be calculated using the coefficient $h_i$ shown in FIG. 9, since it is within the tube that chaotic mixing occurs. The enhancement factor due to the presence of chaotic mixing is $h_{i(AA)}/h_{i(CA)}$ which was determined to be 0.938 $Re^{0.015}$. This ratio is graphed in FIG. 10. The shape of this curve is qualitatively similar to that found by analysis and shown in FIG. 4B.

The maximum flow rate and Reynolds number Re that could be attained were determined by the maximum height to which the overhead tank could be raised. The maximum Reynolds number Re according to the experiments was slightly less than 10,000. It is important to relate the critical Reynolds number Re for transition from laminar to turbulent flow which had to be determined by experimentation.

The onset of instability in a straight pipe is a subcritical Hopf bifurcation, with large amplitude perturbations and nonlinear phenomena being responsible for transition from laminar to turbulent flow. The friction factor for this case usually undergoes a jump as the Reynolds number Re is increased through the transition region. In a coiled tube, on the other hand, transition is a smooth event according to this invention, with the friction factor-Reynolds number Re curve undergoing only a change in slope at transition. This instability is most likely due to a supercritical Hopf bifurcation.

Figure 11:
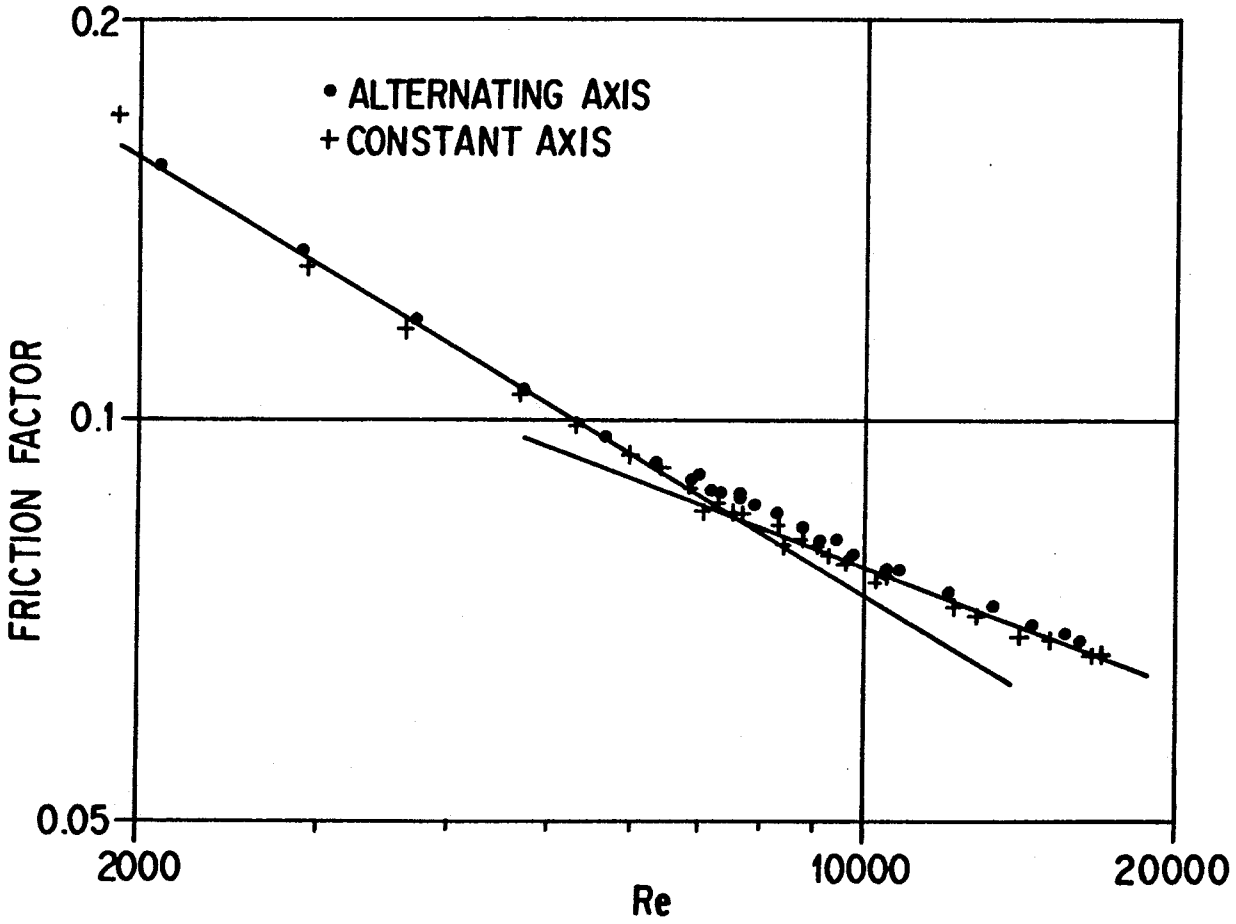
FIG. 11 is a graphical representation of experimental results showing the friction factor for the alternating axis coil and the constant axis coil, each as a function of the Reynolds number Re.

FIG. 11 shows the friction factor that was determined for the two coils 10 and 11. For this data only the Reynolds number Re limit was pushed higher by using a pressurized water supply. Though alternating axis coil 11 has a friction factor slightly greater than constant axis coil 10, a linear fit for both sets of data has been shown for the laminar and turbulent branches of the friction factor curve in a log-log plot. The intersection can be considered to give the critical Reynolds number Re for transition. Of the two coils 10 and 11, alternating axis coil 11 shows a smoother transition. However, both coils show almost an identical critical Reynolds number Re of 7270±70. This must be kept in mind when interpreting the results of chaotic mixing. The enhancement of heat transfer reported here is for a Reynolds number Re range straddling the critical value.

The relative increase in pressure drop between the two coils is calculated from the available head loss measurements. The increase showed a marginal dependence on the flow Reynolds number Re, where $h_{f(AA)}/h_{f(CA)}=0.7882\ Re^{0.029}$. This is also plotted in FIG. 10 overlaying the enhancement of the inside heat transfer coefficient The increase is much smaller than that of the heat transfer coefficient.

Uncertainty estimates for the heat transfer coefficient and the pressure drop have been made so as to enable a meaningful comparison between the two coils 10 and 11. Uncertainties for measured quantities are based on measurement resolution and scatter in the data while those for derived quantities are calculated using the Kline-McClintok method. The overall and inner heat transfer coefficients are estimated to have uncertainties of ±1.25% and 2.4% respectively. The envelope of these limits over the mean, representing $\pm\sigma$ with a 68% confidence limit, is shown in FIGS. 8 and 9.

The estimated uncertainty is observed to be smaller than the difference between the two coils 10 and 11, so that the conclusions drawn are indeed meaningful. It is also important to note that the region defined by the $\pm\sigma$ envelope for alternating axis coil 11 is distinctly above that of constant axis coil 10. Thus, there is a small but definite difference in the inner heat transfer coefficient value between the two coils 10 and 11.

The uncertainty in the pressure measurements is possibly due to errors in reading the meter scales as well as a slight unsteadiness in the water levels. It is estimated to be ±1.5 mm within a 68% confidence limit.

It was demonstrated that periodic spatial modulation of the coil axis as in the alternating axis geometry leads to chaotic particle trajectories. Chaotic pathlines conduce not only to better mixing but also to increased heat transfer. Numerical simulations show that the alternating axis geometry of alternating axis coil 11 displays convective heat transfer enhancement which is more than that of constant axis coil 10 which represents conventional coiling geometry. Experiments conducted according to this invention confirm that the effect of increased mixing is also manifested as an increased heat transfer coefficient Increased mixing also leads to larger momentum transport in the radial direction and to a higher pressure drop. The experiments show an enhancement of 6-8% in the in-tube heat transfer coefficient with a corresponding pressure drop increase of 1.5-2.5% over a Reynolds number Re range of 3,000-10,000. Only qualitative comparisons between theory and experiment were possible since the Reynolds number Re in the experiments was much higher than that possible in the numerical simulations. The experiments do demonstrate the heat transfer enhancement due to chaotic mixing, particularly in the turbulent regime.

The enhancement factor due to heat transfer by chaotic mixing increases with increasing flow Reynolds number Re because the secondary flow also increases. It increases with fluid Prandtl number Pr because as Prandtl number Pr of the fluid increases, heat transfer becomes more dependent on advection. It is also found that the increase in heat transfer enhancement due to chaotic mixing is several times the increase in the pressure drop. In other words, the Reynolds analogy expected by persons skilled in the art does not necessarily hold true. This is because the nature of the flow changes completely as flow characteristics go from regular to chaotic mixing, even though the velocity field at a given section remains the same. On decreasing the fluid thermal conductivity, while keeping all other properties and flow quantities the same, the hydrodynamics is not altered and the pressure drop remains the same; however, the heat transfer does change, being larger for the case of chaotic mixing due to the flatter temperature profile.

The geometries of alternating axis coil 11 of this invention were not calculated or optimized in any sense. However, it is apparent that other geometries and fluids may provide larger improvements and more favorable results. It is also possible that chaotic mixing may be used to enhance heat transfer in other types of flows and to augment enhancement due to other mixing techniques. Chaotic mixing is more efficient than regular mixing and can be used for all transport phenomena.

While in the foregoing specification this invention has been described in relation to certain preferred embodiments thereof, and many details have been set forth for purpose of illustration it will be apparent to those skilled in the art that the invention is susceptible to additional embodiments and that certain of the details described herein can be varied considerably without departing from the basic principles of the invention.

We claim:

1. A process for enhancing in-tube heat transfer within a tubular member, comprising:

(a) introducing a fluid into the tubular member;

(b) directing the fluid in a downstream direction through a first coil of the tubular member, said first coil being at a first coil axis;

(c) further directing the fluid in the downstream direction, with respect to the first coil, through a plurality of downstream coils, a corresponding downstream coil axis of each of said downstream coils being rotated at an angle with respect to the coil axis of an immediately upstream coil thereby establishing chaotic flow of the fluid within the tubular member wherein the chaotic flowing fluid has a positive Lyapunov exponent;

(d) maintaining the fluid at a chaotic flow level within at least a portion of said downstream coils thereby increasing an in-tube heat transfer efficiency; and (e) discharging the fluid from the tubular member.

2. A process according to claim 1 wherein the chaotic flow is established by routing the fluid through said downstream coils wherein said angle is approximately 90°.

3. A process according to claim 1 wherein the fluid flow through the tubular member is laminar.

4. A process according to claim 1 wherein the fluid flow through the tubular member is turbulent.

5. A process according to claim 1 wherein the fluid flows through a helical path formed by the first coil and said downstream coils.

6. A heat exchange apparatus comprising:

a tubular member having a fluid inlet and a fluid outlet;

in a downstream direction said tubular member forming a coiled section comprising a first coil oriented along a first coil axis, downstream of said first coil a plurality of downstream coils each oriented along a corresponding downstream coils axis, each said downstream coil axis rotated at an angle with respect to a corresponding coil axis of an immediately upstream coil; and means for establishing and maintaining chaotic fluid flow through at least a portion of said downstream coils thereby increasing an in-tube heat transfer efficiency.

7. A heat exchange apparatus according to claim 6 wherein each said angle is approximately 90°.

8. A heat exchange apparatus according to claim 6 wherein said means maintains said chaotic fluid flow at a turbulent level.

9. A heat exchange apparatus according to claim 6 wherein said means maintains said chaotic fluid flow at a laminar level.

10. A heat exchange apparatus according to claim 6 wherein said coiled section has a helical shape.

* * * * *